United States Patent [19]

Johnson

[11] 4,032,428

[45] June 28, 1977

[54] LIQUEFACTION OF COAL

[75] Inventor: George C. Johnson, Princeton, N.J.

[73] Assignee: Mobil Oil Corporation, New York, N.Y.

[22] Filed: Jan. 28, 1976

[21] Appl. No.: 653,070

[52] U.S. Cl. ..... 208/8; 208/10; 210/39

[51] Int. Cl.[2] ..... C10G 1/06

[58] Field of Search ..... 208/8, 10; 210/39, 40

[56] References Cited

UNITED STATES PATENTS

| | | | |
|---|---|---|---|
| 2,123,380 | 7/1938 | Pott et al. | 208/8 |
| 2,251,748 | 8/1941 | Magill | 210/40 |
| 2,308,247 | 1/1943 | Pott et al. | 208/8 |
| 2,476,999 | 7/1949 | Orchin | 208/8 |
| 3,401,114 | 9/1968 | Carlton et al. | 210/40 |
| 3,505,202 | 4/1970 | Nelson | 208/8 |
| 3,607,718 | 9/1971 | Leaders et al. | 208/8 |
| 3,900,395 | 8/1975 | Hirs | 210/80 |

*Primary Examiner*—Delbert E. Gantz
*Assistant Examiner*—James W. Hellwege
*Attorney, Agent, or Firm*—Charles A. Huggett; Carl D. Farnsworth

[57] ABSTRACT

This invention provides an improved process for solvent-refining coal which involves heating an admixture of coal and a thermally stable organic solvent to solubilize substantially the coal to form a slurry of liquefaction phase and a residual solids phase, and thereafter passing the slurry through a filter bed of crushed raw coal to separate the liquefaction phase from the solids phase.

6 Claims, No Drawings

LIQUEFACTION OF COAL

BACKGROUND OF THE INVENTION

It was recognized by early workers that coal can be liquified by controlled heating in the substantial absence of oxygen. The conversion products are a liquid and a char. Because of the new compelling economic factors, the technology of coal liquefaction and gasification has been expanding at an accelerated pace. Pioneer developments in the field are represented by Lurgi and Fischer-Tropsch technology. More recent advances in coal liquefaction are described in U.S. Pat. Nos. 1,904,586; 1,955,041; 1,996,009; 2,091,354; 2,174,184; 2,714,086; 3,375,188; 3,379,638; 3,607,718, 3,640,816 3,642,608; 3,705,092; 3,849,287; 3,870,621; inter alia.

Hence, by recently developed methods coal can be converted into hydrocarbonaceous liquids by subjecting coal to reaction with solvents, with or without hydrogen, to yield a slurry mixture of dissolved coal and a residuum of unreacted coal and mineral ash. The solids are present in the slurry as a finely divided suspension of insoluble matter.

The suspended solids have a high content of ash and sulfur which reduce the value of the coal as a fuel and for specialized applications. For this reason, it is normal procedure in coal liquefaction operations to separate the undesirable finely divided solids prior to further processing of coal liquefaction products.

The procedure for separating the solids from the coal liquefaction solvent phase has been a serious economic disadvantage in coal liquefaction processes. The fine particle size characteristic of the suspended solids creates formidable difficulties in the application of conventional separation techniques such as filtration, centrifugation and settling.

Existing filtration techniques are unattractive because of slow filtration rates and plugging of filters.

Gravity settling techniques have limited application because of slow settling rates and inefficient ash removal.

Centrifugation techniques for removing the suspended solids have the disadvantage of high equipment and operating costs.

Because of the deficiencies of conventional separation techniques, there remains a need for an effective method for separating finely divided solids from the solvent-rich extract phase of coal liquefaction processes.

Accordingly, it is an object of the present invention to provide an improved coal liquefaction process.

It is another object of this invention to provide an economic method for separating the finely divided suspension of residual solids from the solvent-rich extract phase of a coal liquefaction product.

Other objects and advantages shall become apparent from the following description and examples.

DESCRIPTION OF THE INVENTION

One or more objects of the present invention are accomplished by the provision of a process for liquefaction of coal which comprises admixing comminuted coal with a thermally stable organic solvent having a boiling point in the range between about 450° and 950° F; heating the admixture at a temperature between about 350° and 850° F for a period of time sufficient to solubilize substantially the coal and form a slurry of a homogeneous fluid liquefaction phase and a solids phase of ash and residual coal; passing the said slurry through a filter bed zone to separate the liquefaction phase from the solids phase, wherein said filter bed comprises crushed raw coal; and recovering the liquefaction phase as an effluent from the filter bed zone.

By the term "thermally stable" organic solvent is meant a solvent medium which is substantially composed of polycyclic aromatic hydrocarbon derivatives having a boiling point in the range between about 400° and 1000° F. Polycyclic hydrocarbons having an aromatic-naphthenic fused ring structure wherein a benzenoid ring and a nonbenzenoid or a naphthenic ring adjacent thereto are fused are especially useful. Other suitable solvents contain a multiple unfused ring structure or both a fused and non-fused ring structure. Specific examples are tetralin, indene, indane, diphenyl, methylnaphthalene, dimethylnaphthalene, fluorene, anthracene, phenanthrene, pyrene, chrysene, and larger molecules containing these moieties. Commercially available mixtures including one or more of the above mentioned compounds may be derived from petroleum refining operations and from other sources such as the destructive distillation of coal, coal tar and oils. Examples of preferred mixtures include anthracene oil, catalytic cracker recycle stocks such as light recycle catalytic cracker oil, heavy recycle catalytic cracker oil, and clarified catalytic cracker slurry oil, and thermally cracked petroleum stocks.

The nominal characteristics of suitable thermally stable petroleum solvents are as follows:

| | |
|---|---|
| **Syntower Bottoms** | |
| Sulfur | 1.13% |
| Nitrogen | 450 ppm |
| Pour Point | 50° F |
| Initial Boiling Point | 489° F |
| 95% Point | 905° F |
| Conradson Carbon | 9.96 |
| **Clarified Slurry Oil** | |
| Sulfur | 1.04% |
| Nitrogen | 4400 ppm |
| Pour Point | 50° F |
| Initial Boiling Point | 470° F |
| 95% Point | 924° F |
| Conradson Carbon | 10.15 |
| **Heavy Cycle Oil** | |
| Sulfur | 1.12% |
| Nitrogen | 420 ppm |
| Initial Boiling Point | 373° F |
| 95% Point | 752° F |
| Conradson Carbon | 0.15 |

The coal preferred in the practice of the present invention is of the bituminous type such as Pittsburgh Seam Coal, W. Kentucky No. 14, Illinois No. 6, and the like. The invention process is generally applicable to solid carbonaceous material of natural origin such as sub-bituminous coal, lignite, and the like.

The nominal analyses on a dry weight basis of various coals suitable for use in the invention process are as follows:

| | |
|---|---|
| **High Volatile A** | |
| Sulfur | 1.33% |
| Nitrogen | 1.63 |
| Oxygen | 7.79 |
| Carbon | 80.88 |
| Hydrogen | 5.33 |
| Ash | 2.77 |
| **Sub Bituminous** | |
| Sulfur | 0.21% |
| Nitrogen | 0.88 |
| Oxygen | 15.60 |

-continued

| | |
|---|---|
| Carbon | 65.53 |
| Hydrogen | 5.70 |
| Ash | 3.99 |
| Lignite | |
| Sulfur | 0.53% |
| Nitrogen | 0.74 |
| Oxygen | 32.04 |
| Carbon | 54.38 |
| Hydrogen | 5.42 |
| Ash | 5.78 |

Ball mills or other types of conventional apparatus may be employed for pulverizing coarse coal in the preparation of the comminuted feed coal for the liquefaction step, and the crushed raw coal for the filtration step of the invention process. The crushing and grinding of the coal can be accomplished either in a dry state or in the presence of a liquid such as the solvent being employed in the practice of the invention process.

The average particle diameter of the feed coal is preferably below about 0.05 inches. The average particle diameter of the crushed raw coal in the filter bed zone of the invention process is preferably in the range between about 0.05 and 0.05 inches. For purposes of convenience and economy, the same source of coarse raw coal is pulverized and sized for use both as the feed coal and the filter bed coal.

In the practice of the invention process, the comminuted feed coal and the thermally stable solvent are charged to a reactor vessel in the desired proportions, and in the manner of prior art coal liquefaction procedures the mixture is heated at a temperature in the range between about 500° and 900° F, and preferably at a temperature between about 700° and 850° F, until more than about 55 percent of the coal is solubilized in the organic solvent. The heating step of the process will require a period between about 0.1 and 5 hours, and normally a period between about 0.2 and 1.5 hours.

Although it is not essential, the liquefaction reaction can be conducted under a hydrogen pressure between about 100 and 2000 psi, and optionally in the presence of a hydrogenation catalyst containing metals such as molybdenum, zinc, magnesium, tungsten, iron, nickel chromium, vanadium, palladium, platinum, and the like. High temperature, sulfur-resistant catalysts such as molybdenum and tungsten sulfide are particularly suitable.

The thermally stable solvent is provided in a quantity between about 0.5 and 10 parts by weight per part by weight of the comminuted coal being solubilized. Normally, the preferred ratio will be in the range between about 1.0 and 5 parts by weight of organic solvent per part by weight of coal.

In a typical embodiment of the invention process, the coal liquid is produced by (1 ) heating a mixture of powdered coal and recycle coal solvent (e.g., a distillation fraction recovered in a coal liquefaction process) at a temperature of about 790° F under a hydrogen pressure of about 1000–2000 psi for a period of about one hour; and (2 ) passing the resultant slurry of liquid phase and finely divided solids phase through a filtration zone of crushed coal at a temperature between about 400° and 750° F, and preferably at a temperature between about 500° and 600° F. The rate of filtration is determined primarily by the viscosity of the slurry, the quantity of solids suspended therein, the pressure differential across the filtration zone, and the average particle size distribution of the raw coal filtration medium.

The rate of filtration is maintained at a level which satisfies the practical aspects and economic requirements of an integrated coal liquefaction system. Typically, more than about two weights of liquid are filtered through one weight of coal charged to the filter bed. By careful choice and control of the liquid/filter bed ratio, the filtration system can be operated at the optimum balance between filtration rate and effectiveness. The used filter bed is removed continuously before it becomes plugged, and the fresh bed is improved in percent of solids removed by entrapment in the filter bed.

In another important embodiment of the present invention process, the filtration zone is established as a vertically disposed downward moving bed of crushed raw coal. The slurry of fluid liquefaction phase and solids phase is continuously introduced into the middle area of the filtration zone, and moves upward and countercurrent to the downward moving filter bed.

Fresh raw coal is continuously fed into the filtration zone near the upper end, and a mixture of raw coal and liquefaction solids is continuously removed from the lower end of the filtration zone. The slurry enters the filtration system and passes upward through the bed of crushed coal. The residual solids phase is trapped by the filter bed, and the solids-free liquid phase is removed overhead.

Optionally, a stream of lean solvent (i.e., preferably the same solvent employed in the coal liquefaction step) is introduced near the lower end of the filtration zone and passed upward and countercurrent to the downward moving bed of raw coal and liquefaction solids. This serves to strip the filtration bed of liquefaction fluid and pass it upward for removal with the overhead product stream. Usually the particle size distribution of the crushed coal employed in the filter bed will be relatively uniform as a function of time, but in one option a different size crushed coal is fed intermittently as a means for adjusting the balance between rate of filtration and the completeness of solids removal.

The overhead stream of solids-free liquefaction phase is passed into a separation system for the recovery therefrom of valuable liquid fuels, recycle solvent, and the like. Also, the overhead stream can be charged to other process units, such as those producing high purity coke, carbon black, and the like.

The contaminated filter bed mixture of raw coal and liquefaction solids can be subjected steam stripping to remove residual liquefaction phase components, and thereafter recovered as a dry powder for use as a fuel. Part of the filter bed material can be recycled to the reactor, or used as feed in a separate and similar reactor.

If desired, the overhead liquid stream can be subjected to distillation to remove the solvent and the volatile components. The high boiling distillation residuum is recovered as solventrefined coal.

Solvent-refined coal produced in accordance with the present invention process is low in sulfur and ash content and is high in asphaltene content. Nominally, typical solvent-refined coal so produced is substantially free of ash and has a much lower oxygen and sulfur content than the original feed coal. The solvent-refined coal is about 40 to 60 percent soluble in benzene (insoluble in pentane) and about 40 to 60 percent soluble in pyridine (insoluble in benzene).

The following Example is further illustrative of the present invention. The reactants and other specific ingredients are presented as being typical, and various modifications can be derived in view of the foregoing disclosure within the scope of the invention.

The Example summarizes physical and chemical characteristics of W. Kentucky and Illinois types of coal, and the solvent-refined coal which can be derived therefrom in accordance with the practice of the present invention process.

EXAMPLE

| | W. Kentucky 14 | | | Illinois No. 6 | | |
|---|---|---|---|---|---|---|
| | Coal | | | Coal | | |
| | Dry | Dry Ash Free | SRC Product | Dry | Dry Ash Free | SRC Product |
| C | 72.98 | 79.0 | 87.6 | 70.22 | 79.4 | 85.3 |
| H | 5.12 | 5.9 | 4.8 | 4.75 | 5.4 | 5.6 |
| N | 1.33 | 1.4 | 2.0 | 1.42 | 1.6 | 1.8 |
| S | 3.06 | 3.3 | 0.8 | 3.22 | 3.6 | 0.9 |
| Ash | 8.48 | — | 0.7 | 11.57 | — | 1.5 |
| O | 9.03 | 9.8 | 3.4 | 8.82 | 9.9 | 4.3 |
| Coal | $C_{100}H_{88}N_{1.5}S_{1.5}O_9$ | | | Coal | $C_{100}H_{89}N_{1.5}S_{1.5}O_9$ | |
| SRC | $C_{100}H_{66}N_{1.9}S_{0.3}O_{2.9}$ | | | SRC | $C_{100}H_{78}N_{1.8}S_{0.4}O_{3.8}$ | |
| 7800 SCF $H_2$/ton coal | | | | Yield SRC 55% | | |
| 8.5 atoms H/100 C | | | | | | |

What is claimed is:

1. In a process for the liquefaction of coal, the improvement which comprises admixing comminuted coal with a thermally stable organic solvent having a boiling point in the range between about 450° and 950° F; heating the admixture at a temperature between about 500° and 900° F for a period of time sufficient to solubilize substantially the coal and form a slurry of a homogeneous liquefaction phase and a solids phase of ash and residual coal; thereafter passing the said slurry through a filter bed zone to separate the liquefaction phase from the solids phase, wherein said filter bed comprises crushed raw coal; and recovering the liquefaction phase as an effluent from the filter bed zone.

2. A process in accordance with claim 1 wherein the said admixture of coal and organic solvent is heated for a period of time between about 0.1 and 5 hours.

3. A process in accordance with claim 1 wherein the organic solvent in the admixture is present in a quantity between about 0.5 and 10 parts by weight of organic solvent per part by weight of coal in the admixture.

4. A process in accordance with claim 1 wherein the crushed raw coal in the filter bed zone has an average particle diameter in the range between about 0.05 and 0.5 inches.

5. A process in accordance with claim 1 wherein the slurry of liquefaction phase and solids phase is passed upward through a downward moving filter bed of crushed raw coal, and the liquefaction phase free of solids is recovered as an overhead stream.

6. A process in accordance with claim 1 wherein the slurry of liquefaction phase and solid phase is passed through the filter bed zone at a temperature between about 400° and 750° F.

* * * * *

UNITED STATES PATENT AND TRADEMARK OFFICE

CERTIFICATE OF CORRECTION

PATENT NO. : 4,032,428

DATED : June 28, 1977

INVENTOR(S) : GEORGE C. JOHNSON

It is certified that error appears in the above-identified patent and that said Letters Patent are hereby corrected as shown below:

Column 3, line 24 "0.05 and 0.05 inches." should be -- 0.05 and 0.5 inches --.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*